US008740188B1

(12) United States Patent
Foster

(10) Patent No.: US 8,740,188 B1
(45) Date of Patent: Jun. 3, 2014

(54) CABINET LIFTING DEVICE

(76) Inventor: Roy Foster, Catlin, IL (US)

( * ) Notice: Subject to any disclaimer, the term of this patent is extended or adjusted under 35 U.S.C. 154(b) by 807 days.

(21) Appl. No.: 13/008,834

(22) Filed: Jan. 18, 2011

Related U.S. Application Data

(63) Continuation-in-part of application No. 11/607,939, filed on Dec. 4, 2006, now abandoned.

(51) Int. Cl.
*B66F 7/02* (2006.01)

(52) U.S. Cl.
USPC ..... 254/4 R; 414/10; 248/354.1

(58) Field of Classification Search
USPC ..... 254/4 R, 4 B, 4 C; 269/55, 56, 289 R, 269/904; 414/10; 248/354.1, 354.6, 354.7
See application file for complete search history.

(56) References Cited

U.S. PATENT DOCUMENTS 4,508,316 A * 4/1985 Millard ..... 254/4 R
4,600,348 A * 7/1986 Pettit ..... 414/11
6,942,198 B2 * 9/2005 Huang ..... 254/387
7,112,026 B1 * 9/2006 Foster ..... 414/10
8,201,809 B2 * 6/2012 Bolton ..... 254/325

* cited by examiner

*Primary Examiner* — Lee D Wilson
*Assistant Examiner* — Jamal Daniel

(57) ABSTRACT

A lifting and supporting device includes elongated supports. One support has a handle attached thereto. A base section has rectilinear support arms attached thereto. The arms are arranged in parallel transverse to a longitudinal length of the base section. The base section is secured to the lower end portions of the supports. Side panels are secured to the upper end portions of the supports. A moveable section is disposed medially of the side panels. A pulley mechanism lifts the movable section in a vertical direction between raised and lowered positions. The pulley mechanism is partially disposed within the cavity and is anchored to the moveable section and the side panels. The pulley mechanism includes at least five pulleys for to decrease the applied force for lifting a cabinet on the movable section. A pressure plate is used to maintain the movable section in a static position during non-operating conditions.

18 Claims, 9 Drawing Sheets

CABINET LIFTING DEVICE

CROSS REFERENCE TO RELATED APPLICATIONS

This application is a continuation-in-part application of U.S. patent application Ser. No. 11/607,939, filed Dec. 4, 2006, the entire disclosure of which is incorporated herein by reference.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a lifting device and, more particularly, to a cabinet lifting device for assisting an operator to maintain a cabinet steady during an installation process.

2. Prior Art

The installation of cabinets and the like within kitchens is difficult for one person to accomplish in view of the size of the cabinets and the confines of the kitchen enclosure. Normally, when installing an item such as a cabinet or ceiling frame, it is necessary for a helper to lift the cabinet in place against a wall or ceiling while the item is secured to the wall or ceiling by the installer. The use of a helper increases the labor cost of such installation. However, there are several drawbacks to using another person as helper.

For example, it is very difficult for a helper to hold a cabinet steady in the selected or proper position. In addition, the helper is usually directly in the installer's way. If the installer does not have a helper, then the installer must use props of some type under the cabinet or must simply be strong enough to hold the cabinet up with one hand while fastening it with the other. These approaches are usually clumsy, unsatisfactory and dangerous. In addition, lifting cabinets can cause back injuries and other medical problems.

It would be highly desirable to provide an apparatus that can be safely operated by one person to lift and hold a cabinet in place while that person secures the cabinet to the wall or ceiling. A further problem associated with positioning such cabinets is the requirement to level and shim the cabinets prior to final installation. The use of conventional vertical lifting devices, per se, does not readily allow such leveling and horizontal positioning of the cabinets.

One prior art example shows a cabinet installation device that includes cabinet support blocks slidably arranged on a pair of rails for providing controlled movement in either direction in the horizontal plane. The support blocks and the rails are supported on a rectangular piston that is vertically controlled by means of a hydraulic jack. Unfortunately, this prior art example requires the use of a power drill to raise and the lower the platform of the device.

Another prior art example shows a device for lifting and holding a cabinet to be mounted to a wall or ceiling. A base member is mounted on a suitable support, and a hollow, linear, elongate drive shaft extends upwardly from the base member. An elongate lift shaft is received coaxially within the drive shaft, with the lift shaft being driven in a longitudinal movement up and down within the drive shaft. At least two elongate, hollow stabilizer shafts are spaced outwardly from the drive shaft, with a longitudinal axis of each stabilizer shaft being substantially parallel with a longitudinal axis of the drive shaft.

An elongate idler shaft is received coaxially within each stabilizer shaft, with each idler shaft being movable longitudinally within its respective stabilizer shaft so that the upper end of the idler shaft can move up and down relative to the upper end of the respective stabilizer shaft. A planar lift plate is attached to the upper end of the lift shaft and the upper ends of each of the idler shafts so that the lift plate moves up and down as the upper ends of the lift shaft and the idler shafts move up and down. The lift plate is constrained to remain substantially perpendicular to the drive shaft by the idler shafts as the lift plate moves up and down. Unfortunately, this prior art example does not provide a suitably stable and wheeled base for use with heavy cabinets and hardware.

Accordingly, a need remains for a cabinet lifting device to overcome the above-noted shortcomings. The present invention satisfies such a need by providing a device that is convenient and easy to use, is lightweight yet durable in design and assists an operator to maintain a cabinet steady during an installation process. Such a device advantageously allows a user to effectively lift a heavy cabinet or other hardware into place safely and easily without the help of another. The device conveniently allows a user to advantageously achieve optimal alignment of a cabinet or other hardware by simply turning the attached handle. The device can be used by do-it-yourselfers as well as professionals. The present invention is simple to use and designed for many years of repeated use.

BRIEF SUMMARY OF THE INVENTION

In view of the foregoing background, it is therefore an object of the present invention to provide a cabinet lifting device for lifting cabinets. These and other objects, features, and advantages of the invention are provided by a device for lifting and supporting a cabinet during installation thereof.

The device includes a plurality of elongated supports that have lower end portions and respective upper end portions effectively disposed substantially vertically thereabove. One of such a plurality of elongated supports conveniently has a handle attached directly thereto for advantageously assisting a user to move and steady the lifting and supporting device respectively during operating conditions. The elongated supports have a combined center of mass vertically aligned and centered for effectively prohibiting the device from undesirably tilting beyond a vertical plane during operating conditions.

The device further includes a base section that has a plurality of rectilinear support arms. Such a plurality of rectilinear support arms is conveniently arranged in parallel transverse to a longitudinal length of the base section, and has opposed ends spaced outwardly from the base section. A plurality of castor wheels is attached to select ones of the opposed ends of the rectilinear arms for conveniently allowing the device to be readily transported between remote locations. Such a base section is effectively secured to the lower end portions of the elongated supports such that the elongated supports are advantageously elevated above a ground surface. The base section maintains the supports in a substantially stable position during operating conditions.

The device further includes a plurality of side panels conveniently secured to the upper end portions of the plurality of elongated supports and effectively defining a cavity therebetween. A moveable section has a longitudinal axis and is disposed substantially medially of the plurality of side panels.

Such a movable section further includes a plurality of spacers connected between the plurality of first support members (herein described below) for assisting to maintain the first support members at substantially stable positions.

The device further includes a pulley mechanism that selectively lifts the movable section in a substantially vertical direction between raised and lowered positions. Such a pulley mechanism is partially disposed within the cavity and is effectively anchored to the moveable section and the plurality of side panels. The pulley mechanism includes a plurality of spaced cross-braces effectively extending substantially parallel to the elongated supports. The pulley mechanism is connected to interior surfaces of the select ones of the plurality of side panels. A plurality of elongated first support members has lower end portions and upper end portions respectively. Such a plurality of first support members is oriented in a substantially vertical position.

The pulley mechanism further includes a support bracket advantageously connected to the upper end portions of the plurality of first support members and to the movable section respectively. An elongated flexible rope and a plurality of sheaves is connected to the plurality of first support members. Such a plurality of sheaves has a grooved rim for receiving the rope therealong for conveniently changing a direction and a point of application of a pulling force, and in a predetermined combination to effectively increase the applied force for conveniently lifting a cabinet positioned onto the movable section. A cranking mechanism operably winds the rope in a predetermined direction.

Such a cranking mechanism includes an elongated shaft that has opposed end portions effectively secured to the plurality of side panels, and extends outwardly from one of the plurality of side panels respectively. The rope has opposed end portions effectively secured to the shaft and the upper end of one of the elongated supports respectively. A gear has a serrated outer surface and is connected to the shaft. A crank handle is connected to the shaft and effectively causes the gear to rotate in a predetermined direction as the handle is radially moved about the shaft. A pawl has a first end portion pivotally connected to the one side panel and further has a second end portion selectively engageable with the gear for advantageously permitting the gear and the shaft to rotate in only one direction, and thereby effectively prevent the moveable section from unexpectedly moving downwardly after a cabinet is placed thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

It is noted the purpose of the foregoing abstract is to enable the U.S. Patent and Trademark Office and the public generally, especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

Figure 1:
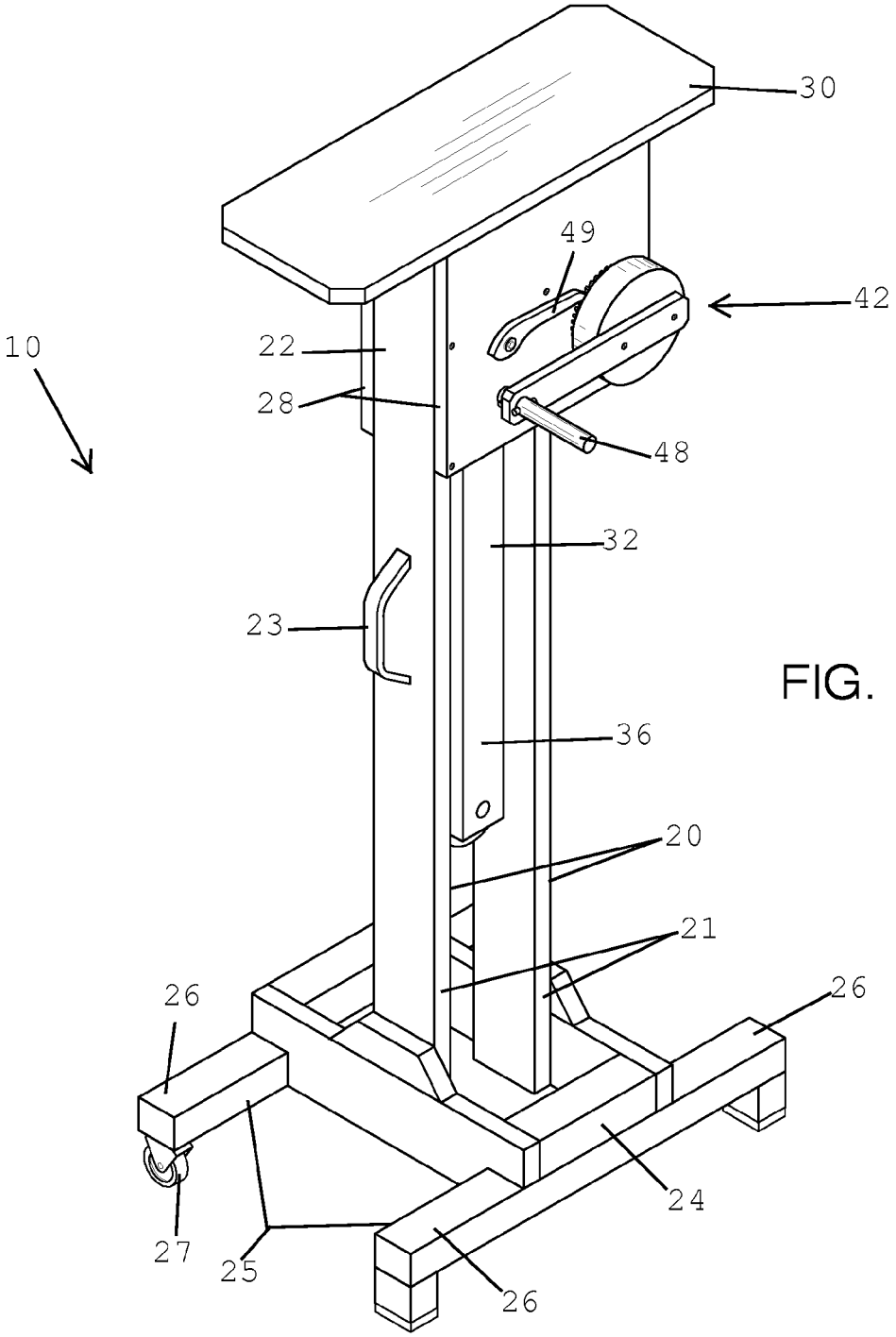
FIG. 1 is a perspective view of a cabinet lifting device, in accordance with the present invention.

Those skilled in the art will appreciate that the figures are not intended to be drawn to any particular scale; nor are the figures intended to illustrate every embodiment of the invention. The invention is not limited to the exemplary embodiments depicted in the figures or the shapes, relative sizes or proportions shown in the figures.

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the figures are to be regarded as illustrative rather than restrictive.

One or more embodiments of the disclosure may be referred to herein, individually and/or collectively, by the term "present invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. §1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The below disclosed subject matter is to be considered illustrative, and not restrictive, and the appended claims are intended to cover all such modifications, enhancements, and other embodiments which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The apparatus of this invention is referred to generally in FIGS. 1-6 by the reference numeral 10 and is intended to provide a cabinet lifting and supporting device. It should be understood that the device 10 may be used to lift many different types of cabinets and other heavy hardware that are normally installed at an elevated position and should not be limited in use to lifting only those types of cabinets and hardware described herein.

Referring initially to FIGS. 1, 2, 3, 4 and 6, the device 10 includes a plurality of elongated supports 20 that have lower end portions 21 and respective upper end portions 22 disposed substantially vertically thereabove. One of such a plurality of elongated supports 20 has a handle 23 attached directly thereto, which is essential for advantageously assisting a user to move and steady the device 10 respectively during operating conditions. The elongated supports 20 have a combined center of mass vertically aligned and centered, which is critical for prohibiting the device 10 from undesirably tilting beyond a vertical plane during operating conditions.

Referring to FIGS. 1, 2, 3 and 6, the device 10 further includes a base section 24 that has a plurality of rectilinear support arms 25. Such a plurality of rectilinear support arms 25 is arranged in parallel transverse to a longitudinal length of the base section 24, and has opposed ends 26 spaced outwardly from the base section 24. A plurality of castor wheels 27 is attached to select ones of the opposed ends 26 of the rectilinear arms 25, which is crucial for allowing the device 10 to be readily transported between remote locations. Such a base section 24 is secured to the lower end portions 21 of the elongated supports 20, which is vital such that the elongated supports 20 are advantageously elevated above a ground surface. The base section 24 maintains the elongated supports 20 in a substantially stable position during operating conditions.

Referring to FIGS. 1, 2, 3, 4 and 5, the device 10 further includes a plurality of side panels 28 secured to the upper end portions 22 of the elongated supports 20 and defining a cavity 29 therebetween. A moveable section 30 has a vertically oriented longitudinal axis and is disposed substantially medially of the plurality of side panels 28. Such a movable section 30 further includes a plurality of spacers 31 connected between the plurality of first support members 32 (herein described below), which is important for assisting to maintain the first support members 32 at substantially stable positions.

Figure 7:
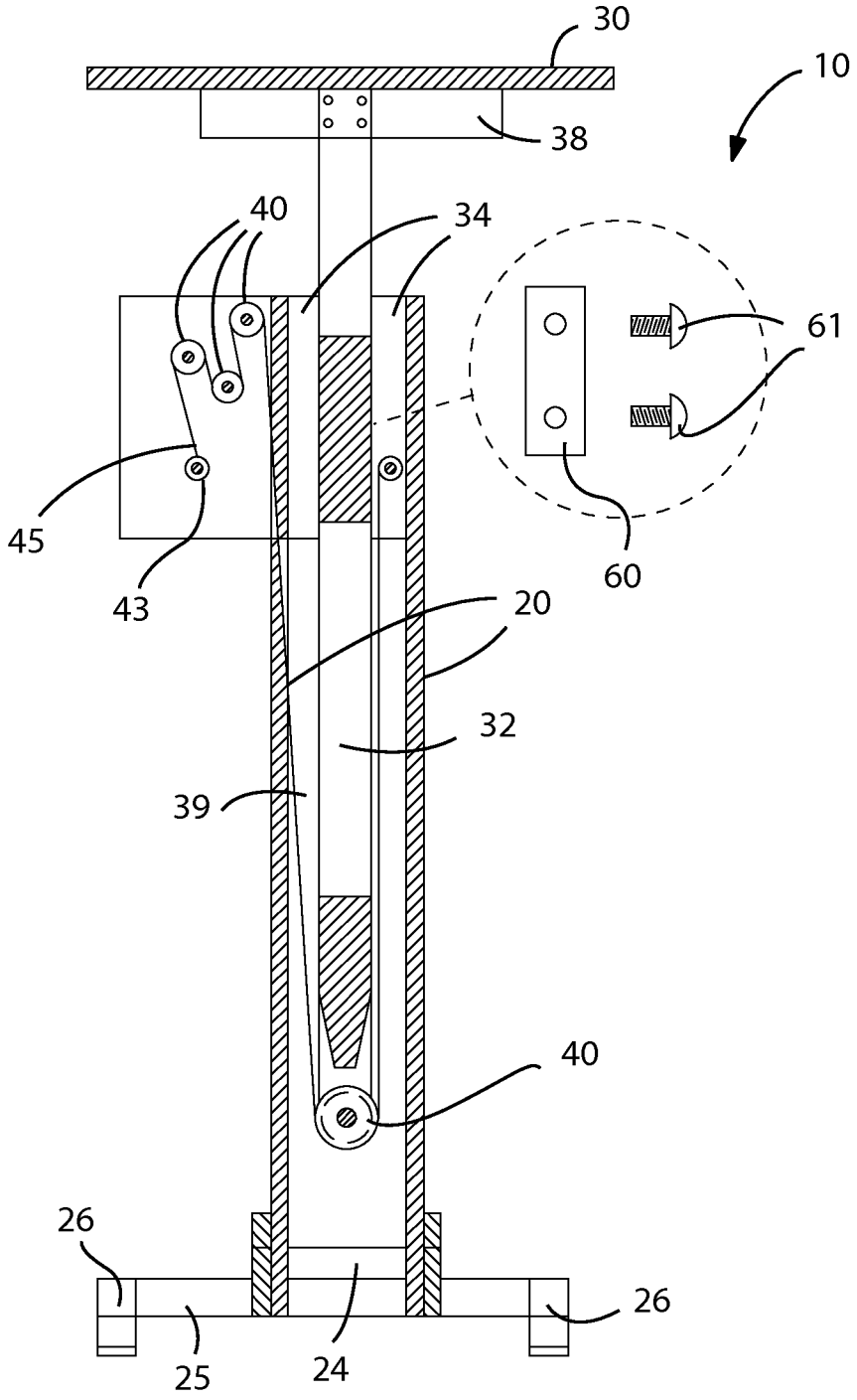
FIG. 7 is a cross sectional view showing the pulley means provided with at least five pulleys, in accordance with an alternate embodiment of the present invention.
Figure 8:
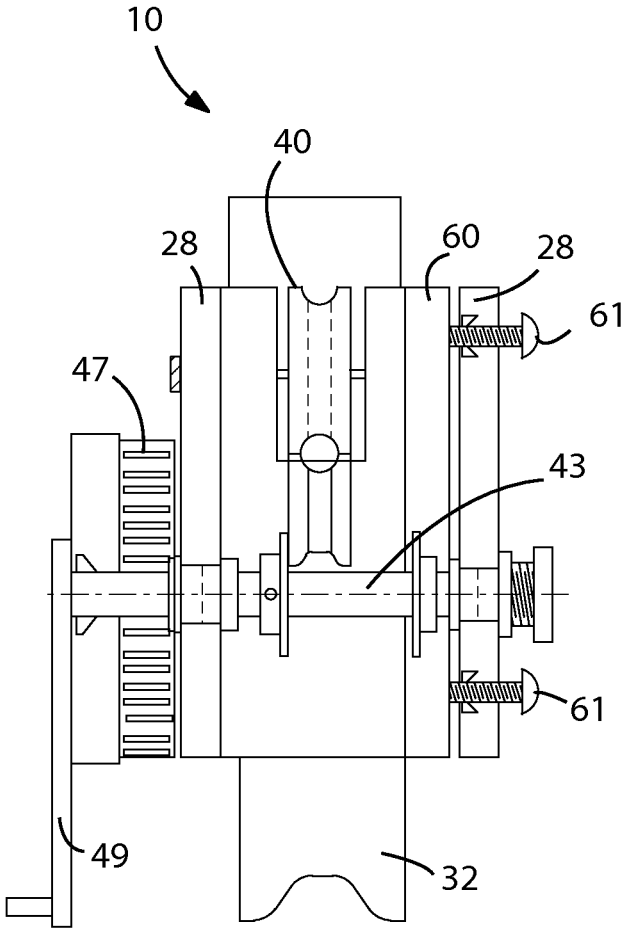
FIG. 8 is a side elevational view showing the interrelationship between some of the components of the cranking mechanism shown in FIG. 4.
Figure 9:
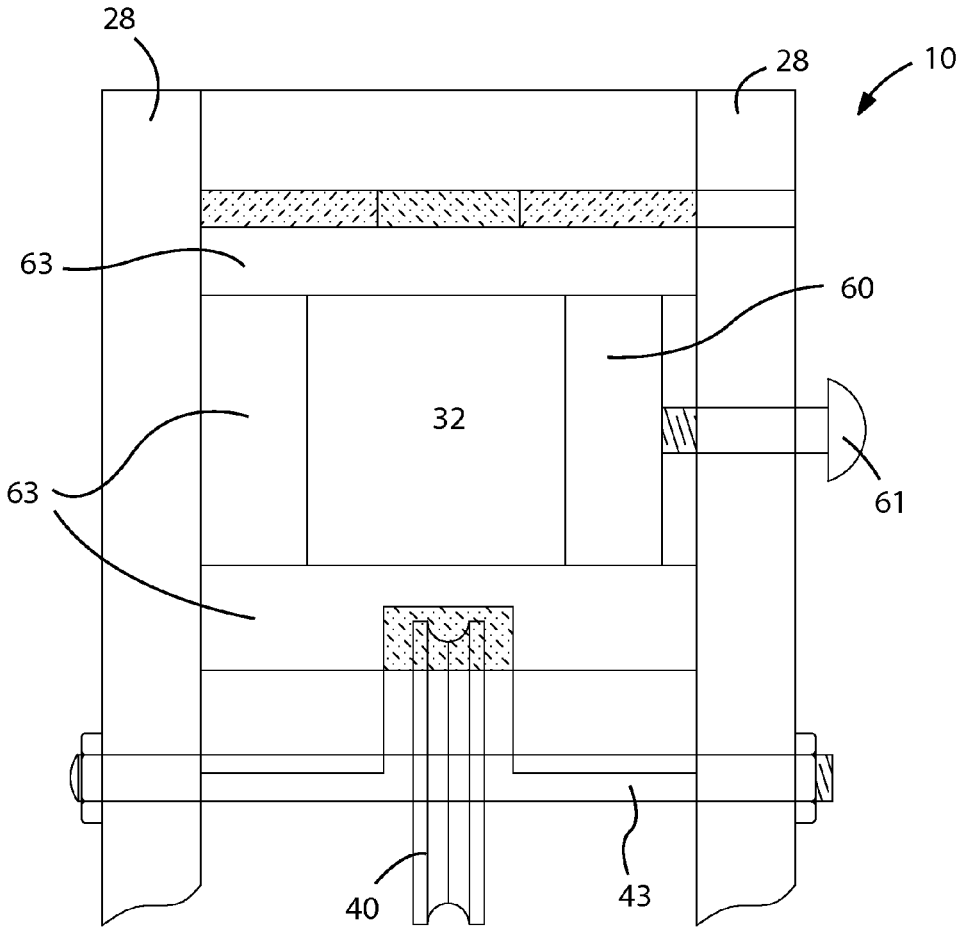
FIG. 9 is a top plan view showing the interrelationship between some of the components of the cranking mechanism shown in FIG. 4.

Referring to FIGS. 1, 2, 3, 5 and 6, the device 10 further includes a pulley mechanism 33 that selectively lifts the movable section 30 in a substantially vertical direction between raised and lowered positions. Such a pulley mechanism 33 is partially disposed within the cavity 29 and is anchored to the moveable section 30 and the plurality of side panels 28. As shown in FIGS. 7-9, a pressure plate 60 may be secured to a rear side portion of the moveable section 30 such that the movable section 30 may be maintained in a static position during non-operating conditions. A plurality of fasteners 61 may further adjustably abut the pressure plate 60 against the moveable section 30. The pulley mechanism 33 includes a plurality of spaced cross-braces 34 extending substantially parallel to the elongated supports 20. The pulley mechanism 33 is connected to interior surfaces 35 of the select ones of the plurality of side panels 28. A plurality of first support members 32 has lower end portions 36 and upper end portions 37 respectively, and is oriented in a substantially vertical position.

Referring to FIGS. 1, 2, 3, 4 and 5, the pulley mechanism 33 further includes a support bracket 38 advantageously connected to the upper end portions 37 of the plurality of first support members 32 and to the movable section 30 respectively. An elongated flexible rope 39 and a plurality of sheaves 40 are connected to the plurality of first support members 32. Of course, such a rope 39 can be formed from a variety of suitably flexible materials, as is obvious to a person of ordinary skill in the art. Referring to FIG. 7 in detail, the plurality of sheaves 40 may include at least five pulleys 40 for receiving said rope 39 therealong and thereby changing a direction and a point of application of a pulling force in a predetermined combination to decrease the applied force for lifting a cabinet 11 positioned on said movable section 30. A cranking mechanism 42 operably winds the rope 39 in a predetermined direction.

Referring to FIGS. 1, 2, 4 and 5, the cranking mechanism 42 includes an elongated shaft 43 that has opposed end portions 44 secured to the plurality of side panels 28, and extends outwardly from one of the plurality of side panels 28 respectively. The rope 39 has opposed end portions 45 secured to the shaft 43 and the upper end 22 of one of the elongated supports 20 respectively. A gear 46 has a serrated outer surface 47 and is connected to the shaft 43. A crank handle 48 is connected to the shaft 43, which is critical for causing the gear 46 to rotate in a predetermined direction as the handle 48 is radially moved about the shaft 43. A pawl 49 has a first end portion 50 pivotally connected to the one side panel 28, and further has a second end portion 51 selectively engageable with the gear 46, which is crucial for advantageously permitting the gear 46 and the shaft 43 to rotate in only one direction, and thereby prevent the moveable section 30 from unexpectedly moving downwardly after a cabinet is placed thereon.

Figure 2:
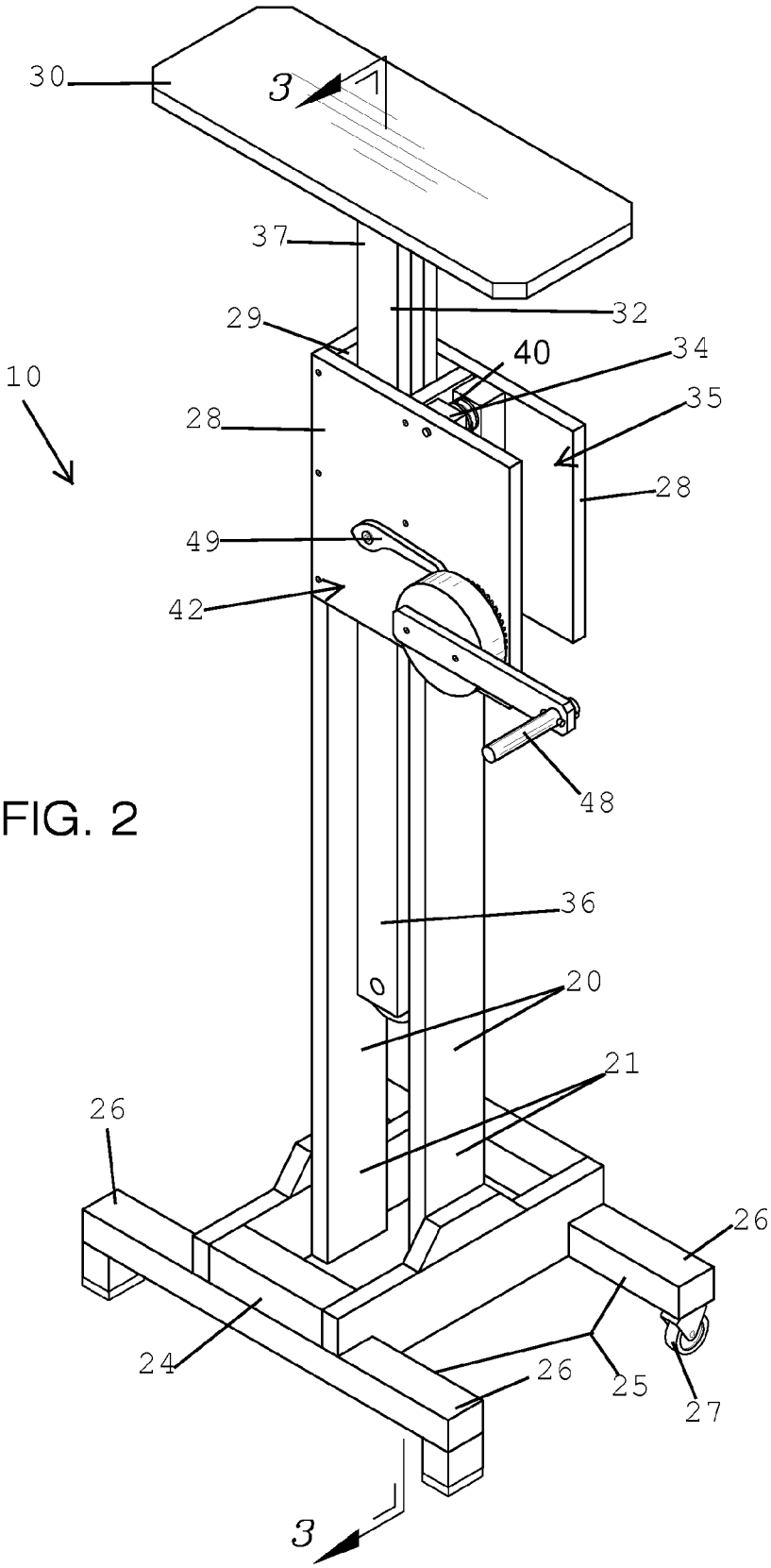
FIG. 2 is a perspective view of the device shown in FIG. 1 showing the moveable section in a raised position.
Figure 10:
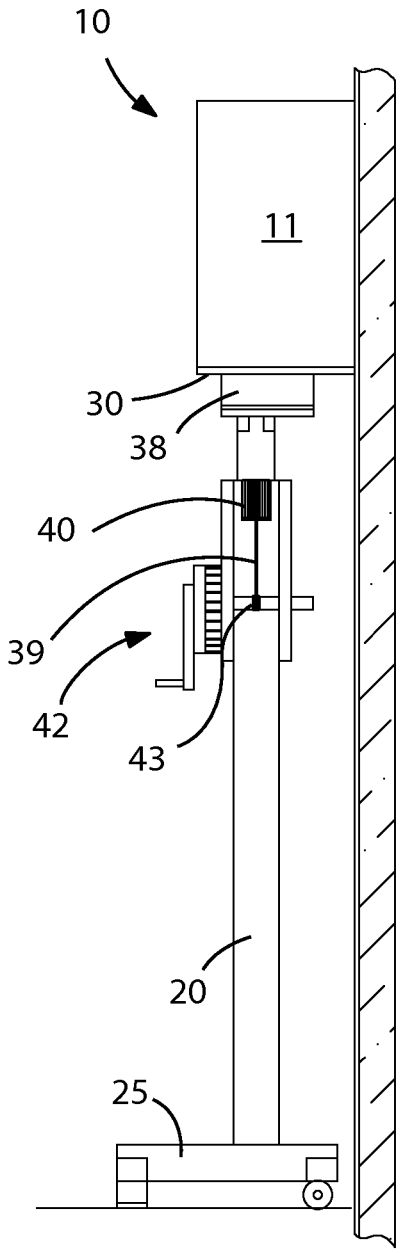
FIG. 10 is a side elevational view showing the device with a cabinet positioned on the movable section.

Referring to FIGS. 1, 2 and 10, a plurality of castor wheels 27 may be attached to select ones of the opposed ends of the rectilinear support arms 25 for allowing the apparatus 10 to be readily transported between remote locations. The use of castors 27 on the base section 24, in cooperation with the cranking mechanism 42, provides the unexpected benefit of allowing a user to place a cabinet or other heavy hardware in an optimal securing position without needing help from others, thereby overcoming prior art shortcomings.

Referring again to FIGS. 7-9, the movable section 30 may further include a plurality of spacers 63 connected between the plurality of first support members 32 for assisting to maintain the first support members 32 at substantially stable positions. The pressure plate 60 has a longitudinal length registered parallel to the moveable section 30 such that the fasteners 61 traverse through one of the side panels 28 and thereby advantageously maintain the pressure plate 60 spaced from the one side panel 28. Such a structural configuration provides the unpredictable and unexpected benefit of reciprocating the cabinet along a substantially linear path such that the cabinet is maintained at a substantially stable position during raising and lowering movements.

Figure 3:
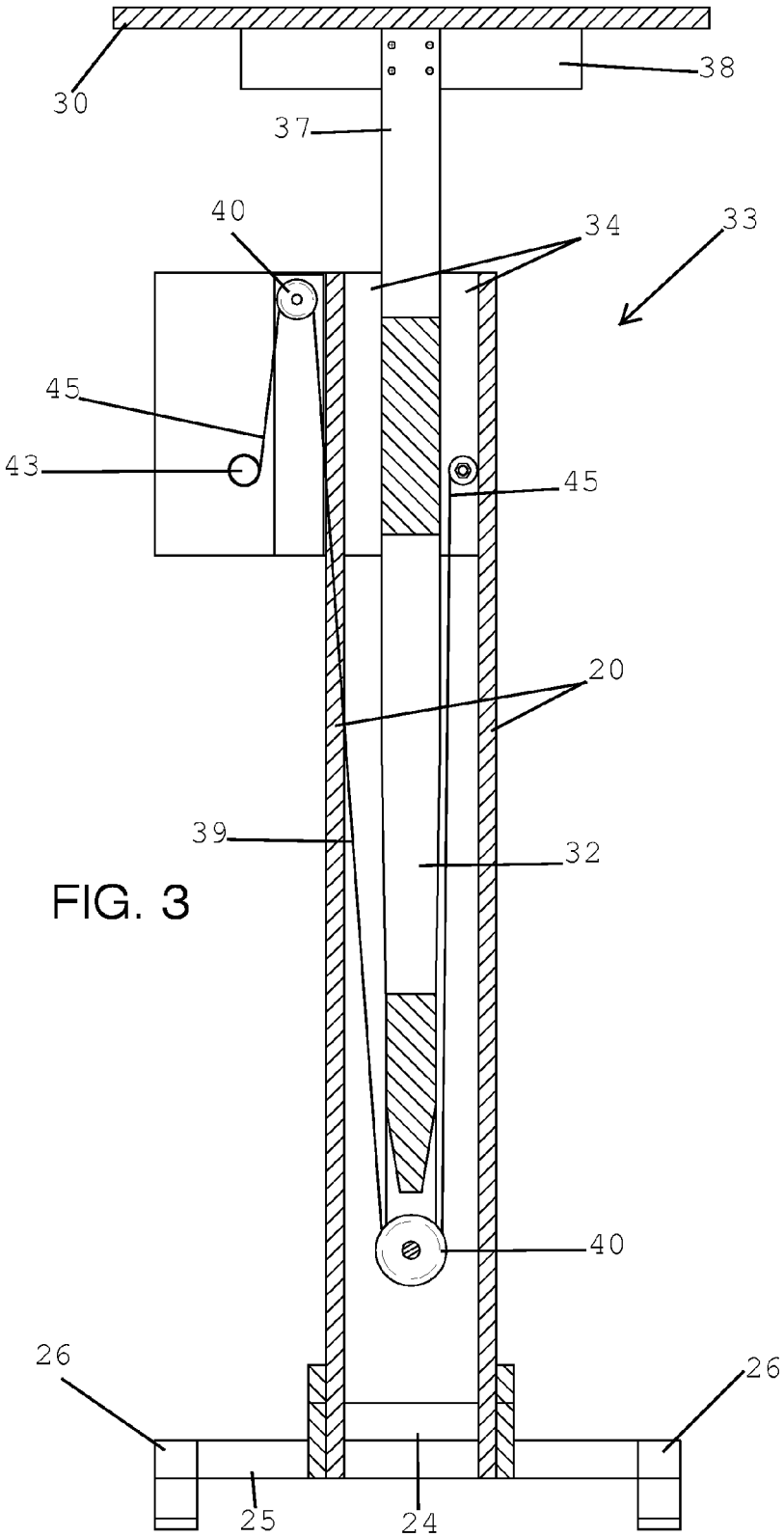
FIG. 3 is a cross sectional view of the device shown in FIG. 2, taken along line 3-3.
Figure 4:
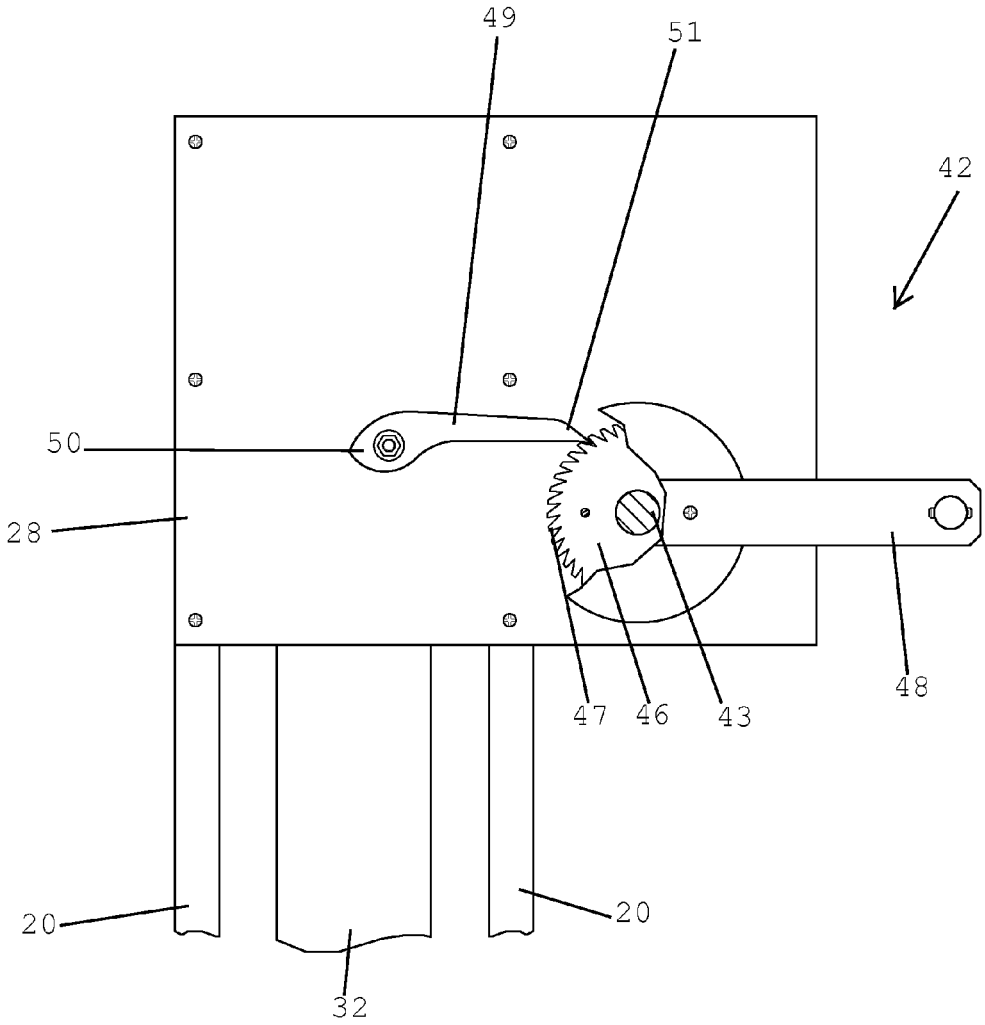
FIG. 4 is a front elevational view of the cranking mechanism.
Figure 6:
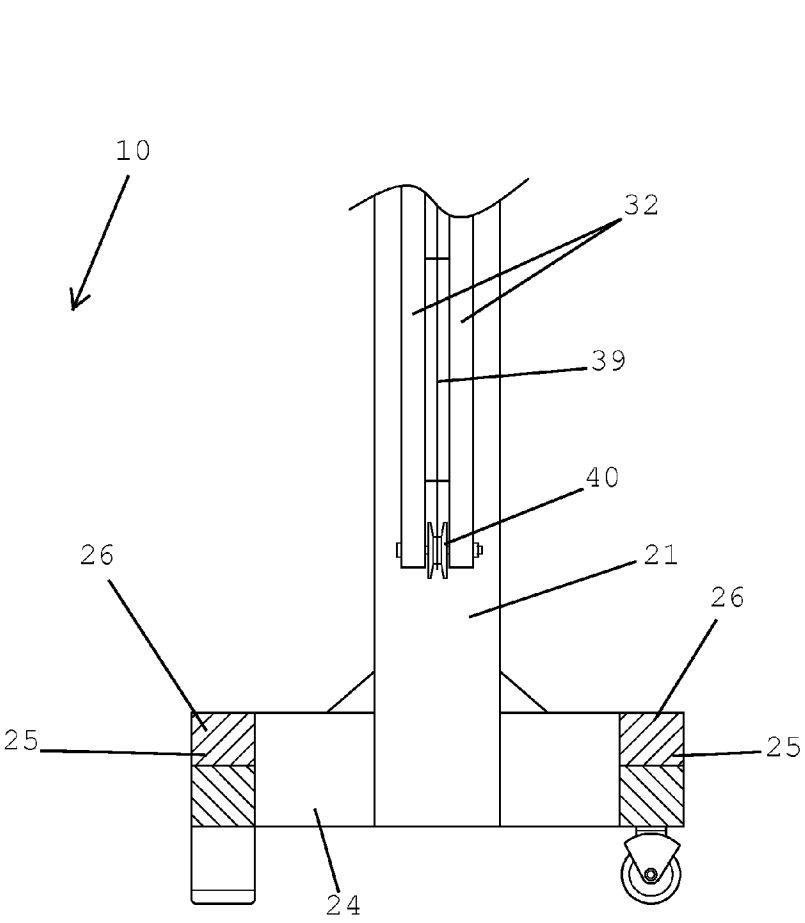
FIG. 6 is a rear elevational view of the lower end of the first support member.
Figure 5:
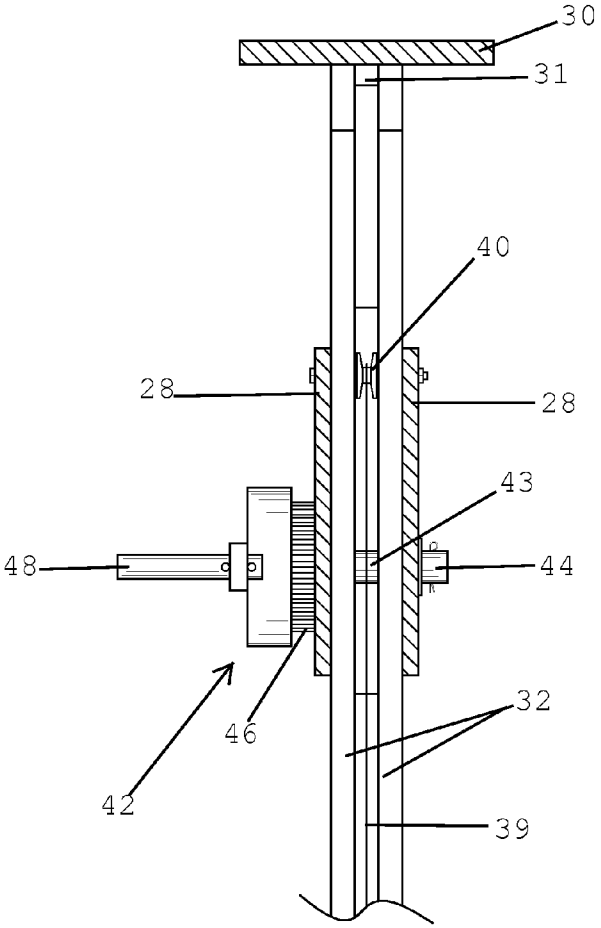
FIG. 5 is a rear elevational view of the cranking mechanism shown in FIG. 4.

Referring to FIGS. 3 and 7, the rope 39 may have opposed end portions secured to the shaft 43 and the upper end of one of the elongated supports 20 respectively.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention. In particular, with respect to the above description, it is to be realized that the optimum dimensional relationships for the parts of the present invention may include variations in size, materials, shape, form, function and manner of operation.

What is claimed as new and what is desired to secure by Letters Patent of the United States is:

1. A device for lifting and supporting a cabinet during installation thereof, said lifting and supporting device comprising:

a plurality of elongated supports having lower end portions and respective upper end portions disposed substantially vertically thereabove;

a base section having a plurality of rectilinear support arms, wherein said plurality of rectilinear support arms is arranged in parallel transverse to a longitudinal length of said base section, said plurality of rectilinear support arms having opposed ends spaced outwardly from said base section, said base section being secured to said lower end portions of said elongated supports such that said elongated supports are elevated above a ground surface, wherein said base section maintains said supports in a substantially stable position during operating conditions;

a plurality of side panels secured to said upper end portions of said plurality of elongated supports and for defining a cavity therebetween;

a moveable section having a vertically oriented longitudinal axis and being disposed substantially medially of said plurality of side panels;

pulley means for selectively lifting said movable section in a substantially vertical direction between raised and lowered positions, said pulley means being partially disposed within said cavity and being anchored to said moveable section and said plurality of side panels;

a pressure plate secured to a rear side portion of said moveable section such that said movable section is maintained in a static position during non-operating conditions; and a plurality of fasteners adjustably abutting said pressure plate against said moveable section.

2. The lifting and supporting device of claim 1, wherein said pulley means comprises:

a plurality of spaced cross-braces extending substantially parallel to the elongated supports and being connected to interior surfaces of said select ones of said plurality of side panels;

a plurality of elongated first support members having lower end portions and upper end portions respectively, said plurality of first support members being oriented in a substantially vertical position;

a support bracket connected to said upper end portions of said plurality of first support members and to said movable section respectively;

an elongated flexible rope and a plurality of sheaves connected to said plurality of first support members, said plurality of sheaves having a grooved rim respectively; and cranking means for operably winding said rope in a predetermined direction;

wherein said plurality of sheaves comprises at least five pulleys for receiving said rope therealong and thereby changing a direction and a point of application of a pulling force in a predetermined combination to decrease the applied force for lifting a cabinet positioned on said movable section.

3. The lifting and supporting device of claim 2, wherein said cranking means comprises:

an elongated shaft having opposed end portions secured to said plurality of side panels and extending outwardly from one said plurality of side panels respectively;

a gear having a serrated outer surface and being connected to said shaft;

a crank handle connected to said shaft and for causing said gear to rotate in a predetermined direction as said handle is radially moved about said shaft; and a pawl having a first end portion pivotally connected to said one side panel and further having a second end portion selectively engageable with said gear for permitting said gear and said shaft to rotate in only one direction and thereby preventing said moveable section from unexpectedly moving downwardly after a cabinet is placed thereon.

4. The lifting and supporting device of claim 1, further comprising:

a plurality of castor wheels attached to select ones of said opposed ends of said rectilinear arms and for allowing said device to be readily transported between remote locations.

5. The lifting and supporting device of claim 1, wherein said movable section further comprises:

a plurality of spacers connected between said plurality of first support members and for assisting to maintain same at substantially stable positions;

wherein said pressure plate has a longitudinal length registered parallel to said moveable section, said fasteners traversing through one of said side panels and thereby maintaining said pressure plate spaced from said one side panel.

6. The lifting and supporting device of claim 2, wherein said rope has opposed end portions secured to said shaft and said upper end of one of said elongated supports respectively.

7. A device for lifting and supporting a cabinet during installation thereof, said lifting and supporting device comprising:

a plurality of elongated supports having lower end portions and respective upper end portions disposed substantially vertically thereabove, one of said plurality of elongated supports having a handle attached directly thereto for assisting a user to move and steady said lifting and supporting device respectively during operating conditions;

a base section having a plurality of rectilinear support arms, wherein said plurality of rectilinear support arms is arranged in parallel transverse to a longitudinal length of said base section, said plurality of rectilinear support arms having opposed ends spaced outwardly from said base section, said base section being secured to said lower end portions of said elongated supports such that said elongated supports are elevated above a ground surface, wherein said base section maintains said supports in a substantially stable position during operating conditions;

a plurality of side panels secured to said upper end portions of said plurality of elongated supports and for defining a cavity therebetween;

a moveable section having a vertically oriented longitudinal axis and being disposed substantially medially of said plurality of side panels; and pulley means for selectively lifting said movable section in a substantially vertical direction between raised and lowered positions, said pulley means being partially disposed within said cavity and being anchored to said moveable section and said plurality of side panels;

a pressure plate secured to a rear side portion of said moveable section such that said movable section is maintained in a static position during non-operating conditions; and a plurality of fasteners adjustably abutting said pressure plate against said moveable section.

8. The lifting and supporting device of claim 7, wherein said pulley means comprises:

a plurality of spaced cross-braces extending substantially parallel to the elongated supports and being connected to interior surfaces of said select ones of said plurality of side panels;

a plurality of elongated first support members having lower end portions and upper end portions respectively, said plurality of first support members being oriented in a substantially vertical position;

a support bracket connected to said upper end portions of said plurality of first support members and to said movable section respectively;

an elongated flexible rope and a plurality of sheaves connected to said plurality of first support members, said plurality of sheaves having a grooved rim respectively; and cranking means for operably winding said rope in a predetermined direction;

wherein said plurality of sheaves comprises at least five pulleys for receiving said rope therealong and thereby changing a direction and a point of application of a pulling force in a predetermined combination to decrease the applied force for lifting a cabinet positioned on said movable section.

9. The lifting and supporting device of claim 8, wherein said cranking means comprises:

an elongated shaft having opposed end portions secured to said plurality of side panels and extending outwardly from one said plurality of side panels respectively;

a gear having a serrated outer surface and being connected to said shaft;

a crank handle connected to said shaft and for causing said gear to rotate in a predetermined direction as said handle is radially moved about said shaft; and a pawl having a first end portion pivotally connected to said one side panel and further having a second end portion selectively engageable with said gear for permitting said gear and said shaft to rotate in only one direction and thereby preventing said moveable section from unexpectedly moving downwardly after a cabinet is placed thereon.

10. The lifting and supporting device of claim 7, further comprising:

a plurality of castor wheels attached to select ones of said opposed ends of said rectilinear arms and for allowing said device to be readily transported between remote locations.

11. The lifting and supporting device of claim 7, wherein said movable section further comprises:

a plurality of spacers connected between said plurality of first support members and for assisting to maintain same at substantially stable positions;

wherein said pressure plate has a longitudinal length registered parallel to said moveable section, said fasteners traversing through one of said side panels and thereby maintaining said pressure plate spaced from said one side panel.

12. The lifting and supporting device of claim 8, wherein said rope has opposed end portions secured to said shaft and said upper end of one of said elongated supports respectively.

13. A device for lifting and supporting a cabinet during installation thereof, said lifting and supporting device comprising:

a plurality of elongated supports having lower end portions and respective upper end portions disposed substantially vertically thereabove, one of said plurality of elongated supports having a handle attached directly thereto for assisting a user to move and steady said lifting and supporting device respectively during operating conditions, wherein said elongated supports have a combined center of mass vertically aligned and centered along a centrally registered longitudinal axis of said lifting and supporting device for prohibiting said lifting and supporting device from undesirably tilting beyond a vertical plane during operating conditions;

a base section having a plurality of rectilinear support arms, wherein said plurality of rectilinear support arms is arranged in parallel transverse to a longitudinal length of said base section, said plurality of rectilinear support arms having opposed ends spaced outwardly from said base section, said base section being secured to said lower end portions of said elongated supports such that said elongated supports are elevated above a ground surface, wherein said base section maintains said supports in a substantially stable position during operating conditions;

a plurality of side panels secured to said upper end portions of said plurality of elongated supports and for defining a cavity therebetween;

a moveable section having a vertically oriented longitudinal axis and being disposed substantially medially of said plurality of side panels;

pulley means for selectively lifting said movable section in a substantially vertical direction between raised and lowered positions, said pulley means being partially disposed within said cavity and being anchored to said moveable section and said plurality of side panels;

a pressure plate secured to a rear side portion of said moveable section such that said movable section is maintained in a static position during non-operating conditions; and a plurality of fasteners adjustably abutting said pressure plate against said moveable section.

14. The lifting and supporting device of claim 13, wherein said pulley means comprises:

a plurality of spaced cross-braces extending substantially parallel to the elongated supports and being connected to interior surfaces of said select ones of said plurality of side panels;

a plurality of elongated first support members having lower end portions and upper end portions respectively, said plurality of first support members being oriented in a substantially vertical position;

a support bracket connected to said upper end portions of said plurality of first support members and to said movable section respectively;

an elongated flexible rope and a plurality of sheaves connected to said plurality of first support members, said plurality of sheaves having a grooved rim respectively; and cranking means for operably winding said rope in a predetermined direction;

wherein said plurality of sheaves comprises at least five pulleys for receiving said rope therealong and thereby changing a direction and a point of application of a pulling force in a predetermined combination to decrease the applied force for lifting a cabinet positioned on said movable section.

15. The lifting and supporting device of claim 14, wherein said cranking means comprises:

an elongated shaft having opposed end portions secured to said plurality of side panels and extending outwardly from one said plurality of side panels respectively;

a gear having a serrated outer surface and being connected to said shaft;

a crank handle connected to said shaft and for causing said gear to rotate in a predetermined direction as said handle is radially moved about said shaft; and a pawl having a first end portion pivotally connected to said one side panel and further having a second end portion selectively engageable with said gear for permitting said gear and said shaft to rotate in only one direction and thereby preventing said moveable section from unexpectedly moving downwardly after a cabinet is placed thereon.

16. The lifting and supporting device of claim 13, further comprising:

a plurality of castor wheels attached to select ones of said opposed ends of said rectilinear arms and for allowing said device to be readily transported between remote locations.

17. The lifting and supporting device of claim 13, wherein said movable section further comprises:

a plurality of spacers connected between said plurality of first support members and for assisting to maintain same at substantially stable positions;

wherein said pressure plate has a longitudinal length registered parallel to said moveable section, said fasteners traversing through one of said side panels and thereby maintaining said pressure plate spaced from said one side panel.

18. The lifting and supporting device of claim 14, wherein said rope has opposed end portions secured to said shaft and said upper end of one of said elongated supports respectively.

* * * * *